United States Patent [19]

Hopkins

[11] Patent Number: 4,514,872

[45] Date of Patent: May 7, 1985

[54] ESCALATOR TREAD CLEANING BRUSH

[76] Inventor: Hammond W. Hopkins, 6019 St. Andrews, Dallas, Tex. 75205

[21] Appl. No.: 489,834

[22] Filed: Apr. 29, 1983

[51] Int. Cl.[3] ..... A46B 15/00; A46B 9/02; A46B 9/06

[52] U.S. Cl. ..... 15/256.5; 15/160; 15/301; 15/DIG. 5; 15/DIG. 6; 198/496

[58] Field of Search ..... 15/301, 302, 250.1, 15/DIG. 5, DIG. 6, 160, 106, 256.5, 200; 198/326, 327, 333, 496–499

[56] References Cited

U.S. PATENT DOCUMENTS

| | | | |
|---|---|---|---|
| 1,561,801 | 11/1925 | Shipley | 15/250.1 |
| 2,060,491 | 11/1936 | Dunlop | 15/256.5 X |
| 3,346,900 | 10/1967 | Stewart et al. | 15/160 |
| 3,678,533 | 7/1972 | Crauits | 15/302 |
| 4,255,827 | 3/1981 | Palazzo | 15/DIG. 5 |

FOREIGN PATENT DOCUMENTS

| | | | |
|---|---|---|---|
| 583957 | 9/1959 | Canada | 15/160 |
| 193040 | 3/1938 | Switzerland | 15/160 |

*Primary Examiner*—Peter Feldman

*Attorney, Agent, or Firm*—Richards, Harris, Medlock & Andrews

[57] ABSTRACT

An improved escalator tread cleaning brush (12) is disclosed for use in cleaning the steps (14) of an escalator (10). A brush bar (28) forming a portion of the brush (12) mounts first, second and third sets of bristles (44, 46, 52). The first set of bristles is formed of wire tufts and has a relatively elongate length for brushing the grooves (18) in the steps (14). The second set of bristles is formed of wire tufts and has a relatively short length for cleaning the tread (16) of the steps (14). The third set of bristles is formed of plastic tufts and has a relatively elongate length for cleaning the grooves (18). A spring bar (42) can be used to urge the bristles into cleaning contact with the steps (14). In a first modification, a weight (86) can be used to urge the bristles into cleaning contact with the steps. The brush bar (28) is prevented from movement relative to the rail housings (20, 22) of the escalator (10) by a cross bar (32) extending between the ends of the rail housings.

15 Claims, 5 Drawing Figures

ESCALATOR TREAD CLEANING BRUSH

TECHNICAL FIELD

This invention relates to cleaning, and in particular to the cleaning of the steps of an escalator.

BACKGROUND ART

Escalators are an important part of modern day society. While escalators are made by different manufacturers, they are basically similar in operation. Each escalator has an endless chain of steps which is supported by rotating members at the ends of the escalator. Each step is pivotally attached in the endless chain so that they form a moving staircase on the upper side of the belt for carrying people and a relatively flat surface on the lower return side of the belt. Rail housings are provided on either side of the endless belt and support individual rails which move at the same speed as the steps on the endless belt.

Almost all steps used in escalators have a series of deep grooves in the tread which parallel the motion of the steps. These grooves lend non-skid properties to the steps, diverting any fluids from the top of the tread into the grooves.

As can be readily imagined, the treads and grooves in the steps accumulate dirt and grime constantly from the escalator traffic with the grooves catching most of the debris deposited on the steps. Also, the configuration of the grooves and treads make it very difficult to clean the steps. While the tread of each step is turned upside down as the belt travels about its course, most of the accumulated dirt and grime will not fall off due to gravity alone. The use of a vacuum cleaner or other vacuum device alone also have been found to be ineffective for adequate cleaning of the tread.

Therefore, a need exists for an apparatus and method for efficiently cleaning the steps of an escalator. It would be most desirable to have an apparatus and method which is not labor intensive and which is relatively inexpensive to purchase and operate. Finally, the apparatus and method should be straightforward and easy for untrained personnel to operate.

SUMMARY OF THE INVENTION

In accordance with one aspect of the present invention, an apparatus for cleaning the steps of an escalator is provided. The apparatus includes brush structure having a first set of bristles adapted for cleaning the grooves in the step and a second set of bristles for cleaning the treads of the step. The apparatus further includes structure for urging the brush structure into contact with a step on the escalator so that as the escalator step moves, the first and second set of bristles clean the step of the escalator.

In accordance with another aspect of the present invention, an apparatus is provided for cleaning the steps of an escalator, the escalator having rail housings on either side of the steps thereof. The apparatus includes a brush bar extending generally perpendicular to the direction of motion of the steps and positioned between the rail housings. A first set of bristles is positioned on the brush bar for cleaning the grooves in the steps. A second set of bristles is positioned on the brush bar for cleaning the tread surface of the steps. A third set of bristles is provided for also cleaning the grooves in the steps. A cross bar extends between the ends of the rail supports. At least one arm connects the cross bar with the brush bar so that the brush bar is maintained in a relatively fixed relation to the rail housings so that the steps are cleaned as they move relative to the first, second and third set of bristles.

In accordance with yet another aspect of the present invention, a method is provided for cleaning the steps of an escalator. The method includes the steps of positioning a first set of bristles proximate the grooves in a step and positioning a second set of bristles proximate the tread of the step. The method further comprises the step of urging the bristles into contact with the step so that as the escalator step moves, the first and second set of bristles clean the step. The method can further include the steps of positioning a third set of bristles proximate the groove and urging the third set of bristles into contact with the step for additional cleaning.

BRIEF DESCRIPTION OF THE DRAWINGS

A more complete understanding of the invention may be had by reference to the following Detailed Description taken in conjunction with the accompanying Drawings, wherein.

DETAILED DESCRIPTION

Figure 1:
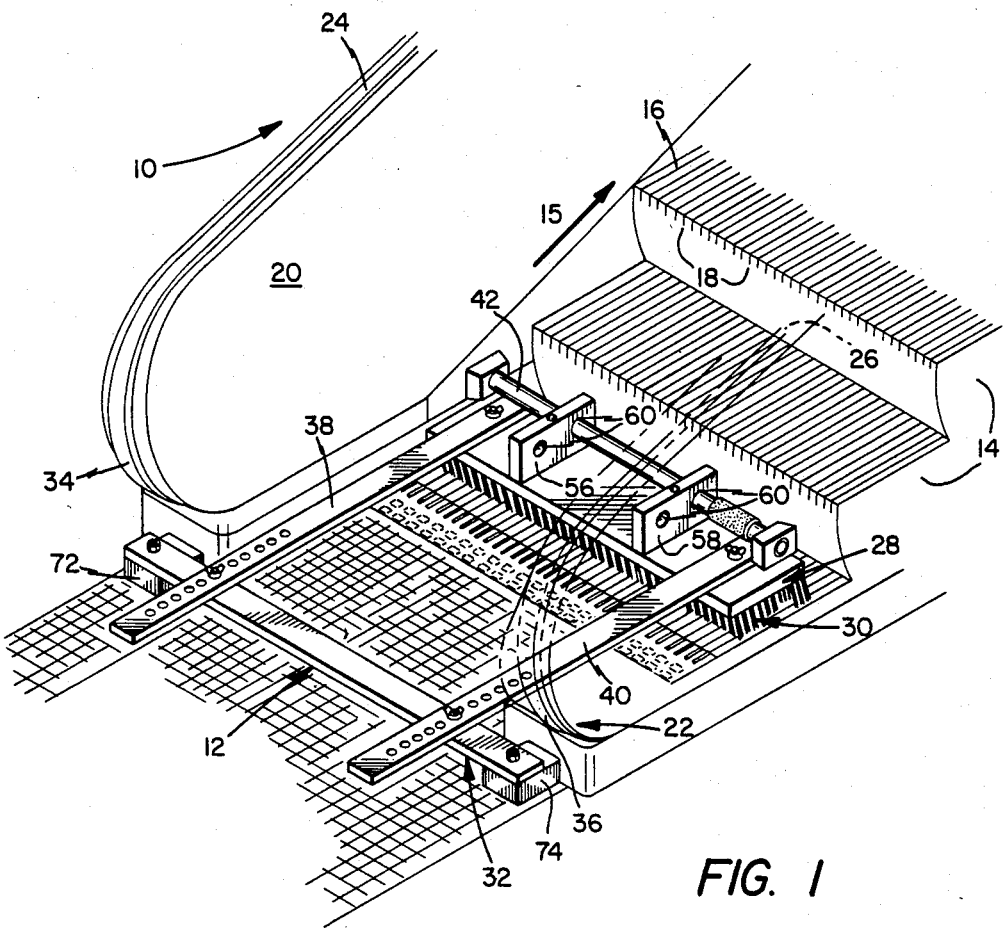
FIG. 1 is a perspective view of an escalator illustrating the use of an escalator tread cleaning brush forming one embodiment of the present invention.

Referring now to the Drawings, wherein like reference characters designate like or corresponding parts throughout several views, FIG. 1 illustrates an escalator 10 of the type commonly found for transporting people from one floor of a structure to another and an improved escalator tread cleaning brush 12 forming a first embodiment of the present invention. The escalator 10 has a plurality of steps 14 which form a continuous loop which moves relative to the remaining portions of the escalator 10. The steps 14 can be moved in either direction, but for purposes of cleaning with brush 12, steps 14 will move upward in the direction of arrow 15. The portions of the steps 14 on which people stand have a tread 16 with deep grooves 18 extending generally along the direction of motion of the steps. Rail housings 20 and 22 are positioned on either side of the steps 14 to support rails 24 and 26. While the rail housings are stationary, the rails 24 and 26 move in unison with the steps 14.

As can be readily imagined, steps 14 collect grime and dirt during operation which must be removed. The escalator tread cleaning brush performs this cleaning function. The brush 12 includes a brush bar 28 which supports the cleaning bristles 30. A cross bar 32 is used to maintain the brush bar 28 in a fixed position relative to the rail housings 20 and 22 as the cross bar 32 has sufficient length to extend across the ends 34 and 36 of the rail housings 20 and 22. Arm pieces 38 and 40 interconnect the cross bar 32 and brush bar 28. A spring bar 42, mounted on the brush bar 28, is expanded into contact with the inner portions of the rail housings 20 and 22 to further fix the brush bar 28 relative to the rail housings.

Figure 3:
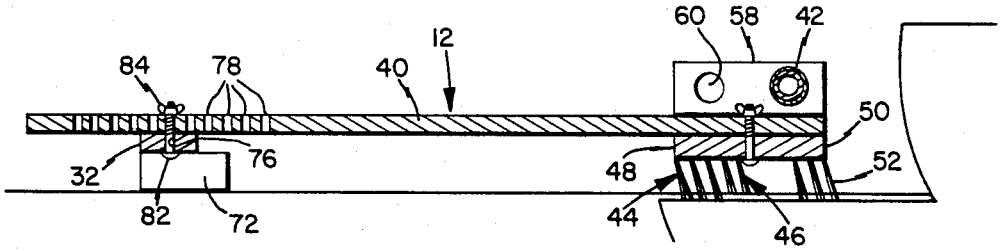
FIG. 3 is a cross-sectional view of the escalator tread cleaning brush taken along line 3—3 in FIG. 2.

With reference now to FIGS. 1–4, the brush bar 28 and cleaning bristles will be described in greater detail. As can best be seen in FIGS. 3 and 4, the cleaning bristles 30 include a first set of bristles 44 and a set of bristles 46 positioned near the front edge 48 of the brush bar 28. In the preferred embodiment, the first and second sets of bristles are formed of wire tufts. The tufts are slanted at an angle $\theta$ to the vertical as best seen in FIG. 3. The length of the first set of bristles 44 is selected so that the bristles extend into the grooves 18 in the step 14 proximate the brush bar 28. The first set of bristles act to scrape and loosen dirt and grime within the grooves. The second set of bristles are sized to contact and clean the tread 16 of the steps 14 as the steps move relative to the brush bar 28. The wire tufts perform an aggressive cleaning action.

Positioned near the rear edge 50 of the brush bar 28 are a third set of bristles 52. In the preferred embodiment, the third set of bristles 52 are formed of plastic tufts. The third set of bristles 52 have a length sufficient to extend into the grooves 18 of the steps. The third set of bristles are preferably somewhat less stiff than the first set of bristles so that their cleaning action has a brushing action to brush away the debris loosened by the first set of bristles 44. However, any other suitable material can be used to form the third set of bristles 52, including wire tufts if the elevator steps need more aggressive cleaning. As seen in FIG. 3, the third set of bristles are also slanted from the vertical at angle $\theta$. One significant advantage achieved by slanting the bristles 44, 46 and 52 at an angle $\theta$ is to make it easier for the bristles to reach the bottom of the grooves 18 of the steps as the steps move past the bristles.

Figure 4:
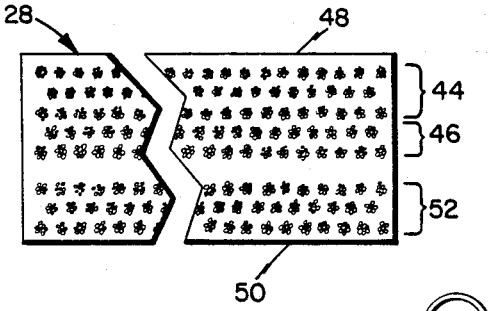
FIG. 4 is a view of the bristle distribution on the brush bar of the escalator tread cleaning brush.

As can be seen in FIG. 4, the first, second and third sets of bristles are all staggered between the front and rear edges 46 and 48 of the brush bar to ensure that all treads 16 and grooves 18 are fully cleaned. The width of the brush bar 28 and the bristles 44, 46 and 52 are selected so that they extend substantially across the entire width of the steps 14 to clean the entire surface area of the steps.

Figure 2:
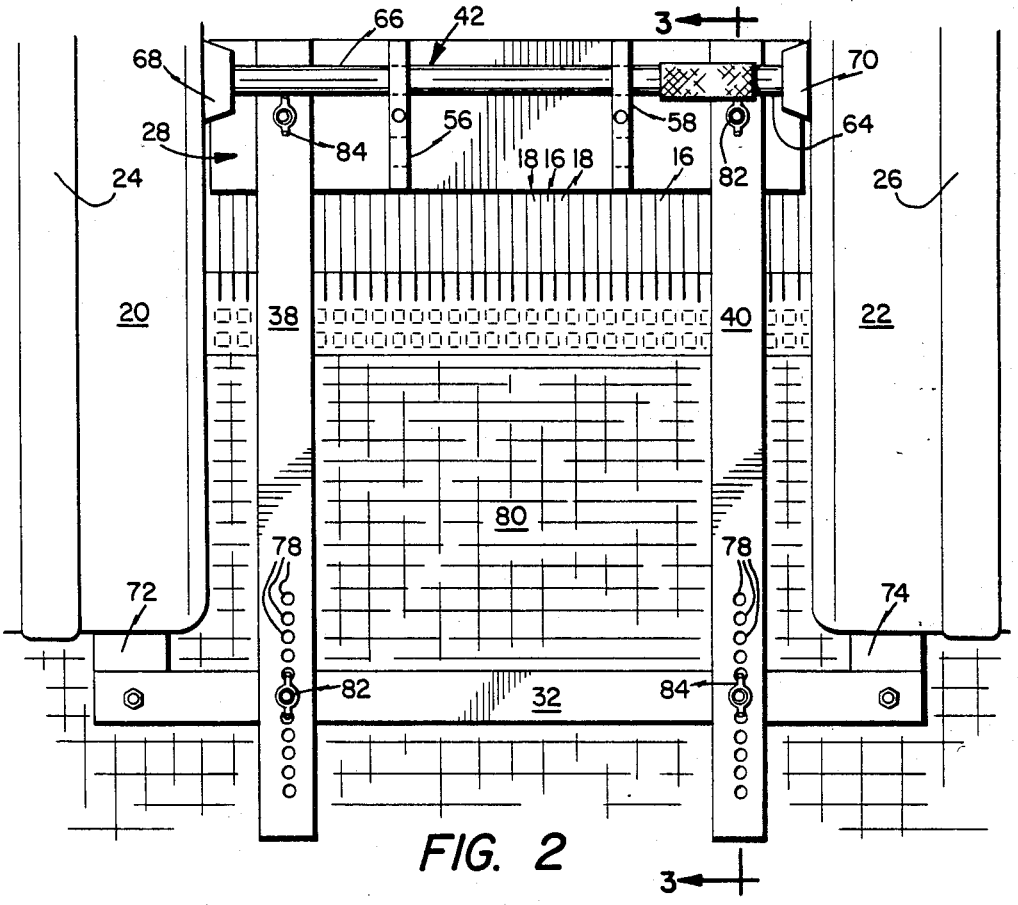
FIG. 2 is a plan view of the lower portion of an escalator illustrating the positioning of the escalator tread cleaning brush.

The upper surface 54 of brush bar 28 supports spring bar brackets 56 and 58. Each of the brackets has twin holes 60 formed therethrough. As can be seen in FIGS. 1 and 2, the spring bar 42 extends through one pair of aligned holes 60. If desired, only one pair of aligned holes 60 need be provided. In the alternative, two spring bars 42 can be used on a single brush 12 to more rigidly secure the brush 12 between the rail housings.

The spring bar 42 is formed with a larger diameter section 64 and a smaller diameter section 66 which are secured together by a threaded connection. Rubber pads 68 and 70 are positioned at the exposed ends of the sections 64 and 66, respectively. The threaded connection of the two sections 64 and 66 is such that rotation of one section relative to another varies the distance between the rubber pads 68 and 70. By twisting the sections relative to each other, the rubber pads can be urged into tight frictional contact with the inner walls of the rail housings 20 and 22. Spring bar 42 can comprise a common chining bar.

In operation, the brush bar is weighted or pushed downward with sufficient force to move the bristles 44, 46 and 52 into cleaning contact with the step 14 proximate the brush bar 28. While this position is maintained, the sections 64 and 66 of the spring bar 42 are rotated relative to each other to firmly lock the spring bar 42 and brush bar 28 between the walls of the housings 20 and 22. With the spring bar 62 locked in position, a constant force is exerted by the bristles on the steps 14 as they move past the bristles to provide an effective cleaning action.

The cross bar 32 is provided with rubber pads 72 and 74 bolted to opposite ends thereof intended for contact with the ends 34 and 36 of the rail housings 20 and 22. This will protect the surfaces of the rail housings and prevent the surfaces from being marred or scratched during the cleaning operation. In addition, these pads 72 and 74 extend below the cross bar 32 to lift the bar off the floor plate 80 to a height generally corresponding to the vertical length of the second set of bristles 46 so that bars 32 and 28 are approximately in the same horizontal plane. As can best be seen in FIG. 2, the cross bar 32 has holes 76 formed therein for attachment to the arm pieces 38 and 40. These holes 76 are positioned so that the attachments between the arm pieces 38 and 40, brush bar 28 and the cross bar 32 form a generally rectangular framework.

Each of the arm pieces 38 and 40 is provided with a series of holes 78, as seen in FIG. 2, to provide adjustment of the distance between the cross bar 32 and the brush bar 28. This feature permits the escalator tread cleaning brush 12 to be adjusted for the size of the floor plate 80 in the escalator and the depth of the steps 14. In the preferred embodiment, the first set of bristles 44 should be no closer than one inch from any part of the floor plate 80. As is clear from the FIGURES, bolts 82 and wing nuts 84 are used to connect the brush bar 28, cross bar 32 and arm pieces 38 and 40. Clearly, any other fastening structure may be utilized as desired.

Figure 5:
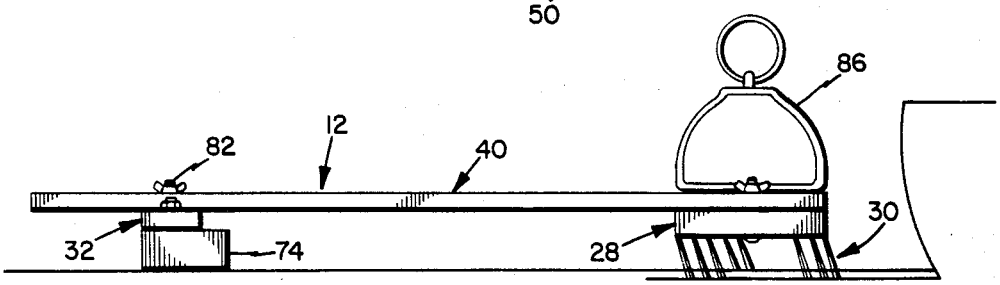
FIG. 5 is a cross-sectional view of a first modification of the escalator tread cleaning brush.

FIG. 5 illustrates a first modification of the escalator tread cleaning brush 12. In this modification, a weight 86 has been positioned on the upper surface 54 of the brush bar 28. The purpose of the weight 86 is to urge the bristles into cleaning contact with the tread 16 and grooves 18 of the steps 14. The weight 86 can therefore substitute for the spring bar 42. However, the weight 86 and spring bar 42 can also be used simultaneously if desired.

As the escalator steps 14 are moved in the direction 15, the escalator tread cleaning brush 12 will clean the individual steps. The cross bar 32 will prevent the bristles from moving relative to the rail housings and spring bar 42 or weight 86 will maintain a force between the bristles and the steps. Preferably, the force between the bristles and step is optimized for the most effective cleaning. Too much weight could flatten the bristles, creating a less effective wiping action. The loosened debris will fall away from the steps as the steps turn upside down at the top of the escalator 10. Where debris has built up over a period of time, excess debris may accumulate at the top of the escalator. This may be vacuumed or brushed away with any brush at the end of the cleaning period. The cleaning time for the escalator 10 can be varied from a few minutes to an hour, or longer, depending on how dirty the steps are. Each pass by the steps 14 under the bristles will loosen more debris until the steps are clean. A vacuum cleaner can also be mounted on brush 12 or proximate thereto for assisting in the cleaning. Naturally, the brush 12 can be positioned at the top of escalator 10 with the steps moving in a direction opposite arrow 15 to achieve equally effective cleaning.

In one escalator tread brush constructed in accordance with the teachings of the present invention, it was found that the optimal cleaning action occurred when a force of approximately one pound per inch of brush bar width was used. As noted previously, this force can be exerted either by a weight 86 or by forcing the bristles into contact with the steps and locking them in that position with the spring bar 42. In this device, the first and third sets of bristles has a length of $1\frac{3}{4}$ inches while the second set of bristles had a length of $1\frac{1}{8}$ inches. The brush bar 28 was constructed of a marine plywood block having a distance of six inches between the front and rear edges 46 and 48 thereof.

As will be evident from the description above and the Drawings, the escalator tread cleaning brush 12 forms an effective device for cleaning the steps 14 of an escalator 10. The brush 12 has a relatively simple construction and is formed of inexpensive materials, providing a low initial cost. The brush 12 is not labor intensive, requiring only a short period of setup. The brush 12 also utilizes the motion of the escalator itself to perform the cleaning action.

Although only a single embodiment of the invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. An apparatus for cleaning the steps of an escalator, the escalator having parallel rail housings for mounting rails in the escalator, comprising:

a brush bar extending generally perpendicular to the direction of motion of the steps and positioned between the rail supports above a step;

a first set of relatively elongate bristles mounted on the brush bar for extending into the grooves in each of the steps for cleaning;

a second set of relatively short length bristles mounted on the bursh bar for contacting the tread of the steps for cleaning, the first and second set of bristles being slanted from the vertical, the first set of bristles being slanted to assist in easing the bristles into the grooves;

a cross bar for extending between the ends of the rail supports for contacting the ends of the rail supports; and at least one arm connected between the cross bar and the brush bar for positioning the brush bar above a step and fixing the brush bar relative to the rail housing so that motion of the steps of the escalator causes the sets of bristles to clean the steps as they pass underneath the cross bar.

2. The apparatus of claim 1 further including a third set of bristles on said brush bar for cleaning the grooves in the step, said first and second set of bristles being formed of wire tufts to scrape debris from the grooves and tread of the steps and said third set of bristles being formed of plastic tufts for brushing the debris from the grooves in the steps.

3. The apparatus of claim 1 further including a third set of bristles on said brush bar for cleaning the grooves in the step, said first, second and third set of bristles each being formed of wire tufts to scrape debris from the grooves and tread of the step.

4. The apparatus of claim 1 wherein said arm permits adjustment of the distance between said cross bar and said brush bar so that said sets of bristles can be positioned in contact with a step on the escalator for cleaning.

5. The apparatus of claim 1 further comprising clamping means for mounting on said brush bar for clamping the brush bar between the rail housings to create sufficient force between the sets of bristles and the steps for effective cleaning.

6. The apparatus of claim 1 further having a weight means associated with said brush bar for urging the sets of bristles into contact with the step of the escalator for effective cleaning.

7. The apparatus of claim 1 wherein the sets of bristles are urged into contact with the step with the force of approximately one pound per inch width of bristles contacting the steps.

8. An apparatus for cleaning the steps of an escalator, the escalator having parallel rail housings for mounting rails in the escalator, comprising:

a brush bar extending generally perpendicular to the direction of motion of the steps and positioned between the rail supports above a step;

a first set of relatively elongate bristles positioned proximate the forward edge of the brush bar for extending into the grooves in each of the steps for cleaning;

a second set of relatively shortened length bristles positioned proximate the forward edge of the brush bar for contacting the tread of the steps for cleaning;

a third set of bristles having a relatively elongate length for entering the grooves in the steps for cleaning, said first, second and third set of bristles being slanted from the vertical, said first and third set of bristles being slanted to assist in easing the bristles into the grooves;

a cross bar for extending between the ends of the rail supports for contacting the ends of the rail supports; and at least one arm connected between the cross bar and the brush bar for positioning the brush bar above a step and fixing the brush bar relative to the rail housings so that motion of the steps of the escalator causes the sets of bristles to clean the steps as they pass underneath the brush bar.

9. The apparatus of claim 8 wherein said first and second sets of bristles are formed of wire tufts and said third set of bristles is formed of plastic tufts.

10. The apparatus of claim 8 wherein said first, second and third sets of bristles are each formed of wire tufts.

11. The apparatus of claim 8 wherein said cross bar has resilient bumper members at each end for contacting the ends of the rail housings to prevent damage to the rail housing.

12. The apparatus of claim 8 wherein said brush bar, cross bar and arm are adjustable relative to each other to permit adjustment of the distance between the cross bar and the brush bar so that the apparatus can be employed with escalators having varied dimensions.

13. The apparatus of claim 9 wherein said brush bar further mounts a spring bar for clamping the brush bar between the inner walls of the rail housings to exert a predetermined force between the sets of bristles and the steps for effective cleaning.

14. The apparatus of claim 8 wherein said apparatus further comprises a weight for positioning on the brush bar for creating a force between the sets of bristles and the steps sufficient for effective cleaning.

15. The apparatus of claim 8 wherein said sets of bristles exert a force on the steps for effective cleaning of approximately one pound per inch of width of the step.

* * * * *

UNITED STATES PATENT AND TRADEMARK OFFICE

CERTIFICATE OF CORRECTION

PATENT NO. : 4,514,872

DATED : May 7, 1985

INVENTOR(S) : Hammond W. Hopkins

It is certified that error appears in the above-identified patent and that said Letters Patent is hereby corrected as shown below:

Column 3, line 38, change "46 and 48" to --48 and 50--.

Column 5, line 13, change "46 and 48" to --48 and 50--.

Claim 1, line 36, change "supports" to --housings--.

Claim 1, lines 47 and 48, change "supports" to --housings--.

Claim 1, line 52, change "housing" to --housings--.

Claim 8, line 21, change "supports" to --housings--.

Claim 8, lines 37 and 38, change "supports" to --housings--.

Claim 11, line 51, change "housing" to --housings--.

Signed and Sealed this

*Eighth* Day of *October 1985*

[SEAL]

*Attest:*

*Attesting Officer*

DONALD J. QUIGG

*Commissioner of Patents and Trademarks—Designate*